US007229956B2

(12) United States Patent
Bedford et al.

(10) Patent No.: US 7,229,956 B2
(45) Date of Patent: Jun. 12, 2007

(54) ANTI-STATIC CLEANING WIPES

(75) Inventors: David Bedford, Hull (GB); Julie Brennan, Hull (GB)

(73) Assignee: Reckitt Benckiser (UK) Limited, Slough, Berkshire (GB)

( * ) Notice: Subject to any disclaimer, the term of this patent is extended or adjusted under 35 U.S.C. 154(b) by 369 days.

(21) Appl. No.: 10/381,128

(22) PCT Filed: Sep. 25, 2001

(86) PCT No.: PCT/GB01/04261

§ 371 (c)(1),
(2), (4) Date: Sep. 11, 2003

(87) PCT Pub. No.: WO02/24859

PCT Pub. Date: Mar. 28, 2002

(65) Prior Publication Data

US 2005/0061686 A1 Mar. 24, 2005

(30) Foreign Application Priority Data

Sep. 25, 2000 (GB) ..... 0023440.1

(51) Int. Cl.
*C11D 17/04* (2006.01)
*C11D 1/88* (2006.01)
*C11D 1/90* (2006.01)

(52) U.S. Cl. ..... 510/439; 510/406; 510/499; 510/501; 510/108

(58) Field of Classification Search ..... 510/439, 510/406, 499, 501, 108
See application file for complete search history.

(56) References Cited

U.S. PATENT DOCUMENTS

| | | | | |
|---|---|---|---|---|
| 4,075,375 | A | 2/1978 | Komatsu | |
| 4,511,489 | A * | 4/1985 | Requejo et al. | 510/243 |
| 5,080,831 | A * | 1/1992 | VanEenam | 510/365 |
| 5,507,968 | A * | 4/1996 | Palaikis | 15/229.11 |
| 5,686,088 | A * | 11/1997 | Mitra et al. | 424/404 |
| 5,686,089 | A * | 11/1997 | Mitra et al. | 424/405 |
| 5,935,596 | A * | 8/1999 | Crotty et al. | 424/448 |
| 5,993,838 | A * | 11/1999 | Crotty et al. | 424/402 |
| 6,106,857 | A * | 8/2000 | Crotty et al. | 424/448 |
| 6,130,197 | A * | 10/2000 | Bedford et al. | 510/421 |
| 6,183,763 | B1 * | 2/2001 | Beerse et al. | 424/404 |
| 6,340,663 | B1 * | 1/2002 | Deleo et al. | 510/438 |
| 6,482,423 | B1 * | 11/2002 | Beerse et al. | 424/404 |
| 6,505,740 | B1 * | 1/2003 | Marlin et al. | 206/524.5 |

FOREIGN PATENT DOCUMENTS

| | | | |
|---|---|---|---|
| DE | 42 01 055 | A | 7/1993 |
| EP | 0531961 | | 3/1993 |
| EP | 0651048 | A2 * | 5/1995 |
| EP | 1 136 031 | A | 9/2001 |
| JP | 63309594 | | 12/1988 |
| JP | 5156300 | | 6/1993 |
| JP | 6296571 | | 10/1994 |
| WO | WO 97/31092 | | 8/1997 |
| WO | WO 97/31092 | A1 * | 8/1997 |
| WO | WO 00/30958 | A1 * | 6/2000 |

OTHER PUBLICATIONS

English language abstract of JP6296571 obtained online from esp@cenet.
English language abstract of JP 5156300 obtained online from esp@cenet.
English language abstract of JP63309594 obtained online from esp@cenet.
English language abstract of EP0531961, which is a correspondent of DE4201055.

* cited by examiner

*Primary Examiner*—Lorna M. Douyon
(74) *Attorney, Agent, or Firm*—Norris McLaughlin & Marcus, PA

(57) ABSTRACT

Wipes are described, premoistened with an anti-static amphoteric cleaning composition. In tests for residual surface charge wipes of the invention showed remarkable charge dissipation properties. Also described are packaged products containing such wipes, use of such wipes in cleaning a surface and the manufacture of such wipes and packaged products.

7 Claims, No Drawings

ANTI-STATIC CLEANING WIPES

The present invention relates to anti-static wipes for cleaning a surface. In particular it relates to a fibrous sheet material—a wipe—which is premoistened with an anti-static cleaning composition.

It is widely accepted that dust collects on a surface due to the presence of residual static charge on the surface above a threshold value. Consequently, in an attempt to minimise the residual static charge on a cleaned surface, and hence reduce the accumulation of dust thereon, cleaning compositions have been developed that include anti-static agents.

These cleaning compositions are contained in a dispenser, such as an aerosol container. In use, the cleaning composition may be dispensed directly onto a target surface and then wiped off with a cloth. During wiping localised areas of the cloth contact the cleaning composition. However, other areas of the cloth come into direct contact with the target surface. This can generate significant static charge on a surface which is capable of holding a static charge. On such a surface, repeated application of the cleaning composition and wiping can therefore generate significant static charge on at least part of the cleaned surface, which may then spread over the whole of the cleaned surface, thereby causing dust to collect upon the surface. This reduces the long term clean look of the surface.

Moreover, the cleaning composition has a tendency to run off surfaces, particularly if those surfaces are not horizontal. This run off leads to wastage and inefficiency, and tends to wet non-target areas. Further, if the cleaning composition is directly applied to the underside of a horizontal surface, the cleaning composition may drip off that surface rather than cling to it.

Alternatively, the cleaning composition may be applied to a portion of a cloth and then wiped onto the target surface. However, the direct contact between those parts of the cloth not containing the cleaning composition and the target surface generates significant static charge on the target surface. Repeated application of the cleaning composition to the target surface therefore produces significant static charge on the cleaned surface which causes dust to collect thereupon.

The present invention therefore seeks to solve the aforementioned technical problems associated with known cleaning methods and apparatus.

According to a first aspect, the present invention provides a moist wipe for cleaning a surface, the wipe comprising a fibrous sheet material premoistened with an anti-static amphoteric cleaning composition.

In use, the target surface is contacted with the moist wipe. This cleans the surface, inhibits the collection of dust on the cleaned surface and provides a long term clean surface. The wipe will normally have no dry portions which could contact the target surface and generate a high level of static charge. Thus, the wipe is preferably thoroughly impregnated with the anti-static amphoteric cleaning composition.

The cleaning composition may contain an anti-static agent and an amphoteric surfactant, as distinct components. Alternatively or additionally it may contain an amphoteric surfactant which has anti-static properties.

Preferably the cleaning composition contains at least one amphoteric surfactant which has anti-static properties.

Suitable amphoteric surfactants which can be used in the cleaning composition include amphoteric betaine surfactants having anti-static properties, notably of the following general formula:

$$R—N^+(R_1)_2—R_2COO^-$$

wherein R is a hydrophobic group which is an alkyl group containing from 10 to 22 carbon atoms, preferably from 12 to 18 carbon atoms, an alkylaryl or arlyalkyl group containing a similar number of carbon atoms with a benzene ring being treated as equivalent to about 2 carbon atoms, and similar structures interrupted by amido or ether linkages; each $R_1$ is an alkyl group containing from 1 to 3 carbon atoms; and $R_2$ is an alkylene group containing from 1 to 6 carbon atoms.

One or more such betaine compounds may be included in the compositions used in the invention.

Preferably, the amphoteric surfactant includes an alkyl amino betaine or an alkyl amido betaine.

Suitable amphoteric surfactants also include cocoamides having anti-static properties, most preferably polyoxyethylene-3-cocoamide.

Suitable amphoteric surfactants also include imidazoline surfactants having anti-static properties, for example sodium capryloamphopropionate (CAS No. 68877-55-4).

Suitable amphoteric surfactants include lactamide surfactants having anti-static properties, for example Lactamide MEA (CAS No. 5422-34-4).

Particularly good results have been found with compositions containing a betaine in combination with a cocoamide.

Particularly good results have been found with compositions containing an imidazoline in combination with a lactamide.

Preferably, the amphoteric surfactant(s) is/are present in an amount (in total) from 0.05% to 15%, more preferably 0.1% to 10%, most preferably 0.1% to 3% by weight of the total weight of the cleaning composition.

Preferably, the amphoteric surfactant(s) is/are non-volatile. By the term "non-volatile" we mean that at ambient temperature, such as 20 to 35° C., and at atmospheric pressure and 20° C. the surfactant(s) do(es) not vaporise significantly. Consequently, in use, a surfactant is deposited on and remains on the target surface thereby providing the cleaned surface with a long lasting anti-static property. This significantly minimises the re-accumulation of dust on the cleaned surface and provides a long term clean surface.

It is believed that particularly effective anti-static amphoteric cleaning compositions are humectants and attract and/or retain moisture. Without being bound by any theory, it is believed that the anti-static amphoteric cleaning compositions may form a conducting layer on the target surface due to the attraction and/or retention of moisture. This conducting layer would allow static charge to dissipate from the cleaned surface thereby enhancing the long term clean effect. Moreover, during storage the attraction of moisture to the anti-static amphoteric cleaning composition would provide the wipe with a beneficial built-in self moisturising system, to prevent the wipe from drying out during storage, thereby increasing the shelf life of the wipe and providing wipes which, during use, retain their moist quality for an extended period.

Preferably, the anti-static amphoteric cleaning composition is an aqueous solution that includes water in an amount of 50% to 98%, preferably 70% to 95%, more preferably 80% to 95% by weight of the total weight of the composition.

Preferably, the anti-static amphoteric cleaning composition includes, as a carrier and/or cleaner, a $C_1$ to $C_4$ alkanol, more preferably ethanol. Preferably the carrier and/or cleaner are each independently present in an amount of 0.5 to 20%, more preferably 2 to 15%, most preferably 5 to 10% by weight of the total weight of the composition.

Preferably, the anti-static amphoteric cleaning composition includes a glossing agent to impart a shine on the clean surface and/or a smear removal agent. Preferred glossing agents include poly ($C_1$ to $C_4$ dialkyl)siloxanes, such as poly(dimethyl siloxane). Agents able to promote smear removal may include said alkanol, water and surfactant(s).

Preferably, the glossing agent and/or the smear removal agent are each independently present in an amount of 0.05 to 5%, preferably 0.05 to 3%, more preferably 0.1 to 2% by weight of the total weight of the composition.

The anti-static amphoteric cleaning composition may also include other optional ingredients which are well known to those skilled in the art, such as preservatives, for example chloromethylisothiazoline, chelating agents, for example ethylene diamine tetraacetic acid sodium salt (EDTA), anionic surfactants, non-ionic surfactants, cationic surfactants and perfumes.

Materials suitable for the fibrous sheet material are well known to those skilled in the art. The fibrous sheet material may be woven or non-woven. For example, the fibrous sheet material may include non-woven fibrous sheet materials such as melt blown, coform, air-laid, bonded-carded web materials, hydroentangled materials and combinations thereof.

Preferably, the fibrous sheet material is a non-woven fibrous sheet material comprising synthetic and/or natural fibres. Most preferably, the non-woven fibrous sheet material comprises viscose and/or rayon fibres which have been spun bonded. Polyolefins are preferably not employed.

Typically, the fibrous sheet material (dry) has a weight of from 40 to 80 grams per cubic metre ($gm^{-2}$), preferably 50 to 70 $gm^{-2}$, most preferably 60 to 70 $gm^{-2}$. A particularly preferred fibrous sheet material has a weight of 65 $gm^{-2}$. Preferably, the wipe has a size in the range 15 to 40 cm by 15 to 40 cm, more preferably in the range 20 to 35 cm×20 to 35 cm. Preferably, the fibrous sheet material has a weight (dry) in the range of 20 to 300 $gm^{-2}$, more preferably 40 to 100 $gm^{-2}$. Preferably the loading of the anti-static amphoteric cleaning composition on the wipe is in the range of 30 to 150 $gm^{-2}$, more preferably 50 to 80 $gm^{-2}$. A particularly preferred embodiment has a size of 20×30 cm using a fibrous sheet material having a weight (dry) of 65 $gm^{-2}$. In this particularly preferred embodiment, the wipe is loaded with preferably 3.5 to 4.5 g of the composition. Most preferably the wipe is loaded with 4 g of the composition. Advantageously, it has been found that this level of loading provides the wipe with sufficient moisture so that it does not dry out but it is not too wet to cause smearing in use.

According to a second aspect, the present invention provides a packaged product comprising an airtight container having a resealable opening and a wipe of the first aspect.

Preferably, the container includes a plurality of wipes which are arranged in a generally folded configuration so that each wipe can be removed from the container one at a time. Such folded configurations well known to those skilled in the art and include C-folded, Z-folded, quarter-folded configurations and the like. Each wipe may also be interfolded with the wipe immediately above and below in the stack of wipes.

Alternatively, wipes could be wound as a roll and separately by perforated tear zones and the container could be a tub having an opening through which wipes are pulled.

According to a further aspect, the present invention provides the use of the wipe as defined hereinbefore for cleaning a surface, for example of furniture. Preferably, the wipe is used to clean surfaces of glass, wood, plastics and the like.

According to a still further aspect, the present invention provides a method of manufacturing a wipe as defined hereinbefore, the method comprising the steps of providing a fibrous sheet material as defined hereinbefore and moistening the sheet material with an anti-static amphoteric cleaning composition as defined hereinbefore.

Preferably, in the manufacturing method, a supply roll of fibrous material is unwound to provide a continuously moving web of material. The web of material is saturated or otherwise impregnated with the liquid anti-static amphoteric cleaning composition by any suitable means such as spraying, dipping, or the like as are well known to those skilled in the art. In a particular aspect, the web of material is passed over several perforated tubes which feed the solution into the material.

The web of material is slit in the machine direction into multiple ribbons, each of which may be folded into the type of fold desired for the individual wipe. The web of material is slit using a cutter, as is well known to those skilled in the art.

The wipes may be stacked by methods well known to those skilled in the art. After the stack of wipes is properly configured, it may be placed in the interior of the container, such as a plastics wrap or tub, to provide a package of wipes. The container provides a substantially hermetically sealed environment for the wipes to minimise the escape of any solution therefrom.

The invention will now be described further with reference to the following non-limiting examples.

Wipes A and B

Wipes of polyester fibres spun bonded into non-woven cloths, premoistened with the anti-static cleaning compositions defined below were produced. Formula A, for Wipe A, represents a low smear formulation and Formula B, for Wipe B, represents a glossing formulation and includes as glossing agent a poly(dimethylsiloxane) which is pre-formulated with an anionic surfactant to form a slightly anionic oil-in-water aqueous emulsion having 35 wt % of the siloxane, and which is available from Rhodia Chimie of Lyon, France, under the trade mark RHODORSIL EMULSION E1P. Both of the Formulae A and B included an amphoteric surfactant comprising an alkyl amino betaine (CAS No. 68424-94-2), as a major component, and tetrasodium EDTA.

Additionally each formula included polyoxyethylene-3-cocoamide, as a further amphoteric surfactant effective as an anti-static agent.

Formula A

| | % w/w |
|---|---|
| Ethanol | 7.0 |
| Alkyl amino betaine | 0.3 |
| Poly oxyethylene-3-cocoamide | 0.3 |
| Chloromethylisothiazolinone | 0.1 |
| Perfume | 0.2 |
| Water | 92.1 |

Formula B

| | % w/w |
|---|---|
| Ethanol | 7.0 |
| Alkyl amino betaine | 0.3 |
| Poly oxyethylene-3-cocoamide | 0.3 |
| Chloromethylisothiazolinone | 0.1 |
| Perfume | 0.2 |
| RHODORSIL EMULSION E1P | 1.0 |
| Water | 91.1 |

The non-woven wipes used were of weight 65 $gm^{-2}$ and individual wipes were rectangles of size 20 cm by 30 cm. The loading of the compositions was 4 g per wipe. This was sufficient to fully impregnate the wipes.

The anti-static properties of the wipes impregnated with Formulae A and B were tested in comparison with Wipes C, impregnated with Comparative Formula C. This is a commercially available aerosol spray product of similar composition, but without the anti-static compounds. The action of a dry duster in relation to static electricity was also assessed.

The assessments were made by measuring the decay time of the induced corona discharge on a plastic surface using a Chubb JCI 155 Charge Decay Test unit. The testing measures the ability of a composition to increase the dissipation rate of an electrostatic charge on a plastic surface.

If a set corona discharge is applied to the test surface whether treated with a composition or not, the decay time of that charge (1/e) may be obtained.

The articles tested were polypropylene tiles of size 20 cm by 20 cm by 0.4 cm. At the start of each test tiles were washed and air dried. The wipe or duster was folded in half and then in half again until it formed a square of approximately 8 cm by 8 cm. The test surface was rubbed in a uniform manner so that the total area was subjected to the same amount of rubbing using 10 complete rubs. The rate (1/e) was measured in seconds, using the Chubb unit in accordance with its instructions.

The results are set out in the following table.

Charge Decay Results

| Wipe | Tile no. | Initial (sec) | 3 day (sec) |
|---|---|---|---|
| Wipe A | 1 | 0.10 | 0.45 |
| Wipe A | 2 | 0.09 | 0.20 |
| Wipe B | 1 | 1.91 | 6.99 |
| Wipe B | 2 | 2.16 | 7.98 |
| Wipe C | 1 | 46.60 | >100 |
| Wipe C | 2 | 27.9 | >100 |
| Dry Duster | 1 | >100 | >100 |
| Dry Duster | 2 | >100 | >100 |

-continued

Charge Decay Results

| Wipe | Tile no. | Initial (sec) | 3 day (sec) |
|---|---|---|---|
| Temp (deg C.) | | 19.4 | 19.4 |
| Humidity (%) | | 52 | 54 |

Wipe D

Wipes D were manufactured as described with reference to Wipes A and B above, except that the formula was as follows:

Formula D

| | % w/w |
|---|---|
| Ethanol | 6.50 |
| Perfume | 0.20 |
| Sodium capryloamphopropionate | 0.30 |
| Lactamide MEA | 0.30 |
| RHODORSIL emulsion EIP | 1.00 |
| 1,2-benzisothiazolin-3-one | 0.15 |
| Water | 91.55 |

Wipes D, moistened with Formula D, were found to have excellent cleaning and anti-static properties.

The invention claimed is:

1. A packaged product comprising a substantially airtight container having a resealable opening and containing a plurality of moist wipes for cleaning a surface, the wipes comprising a fibrous sheet material premoistened with an antistatic amphoteric cleaning composition, the composition containing water, an amphoteric alkylamino betaine surfactant having antistatic properties and a cocoamide having anti-static properties wherein the cocoamide is polyoxyethylene-3-cocoamide.

2. A packaged product according to claim 1 wherein the total weight of amphoteric surfactant present in the composition is 0.1% to 3% of the total weight of the composition.

3. A packaged product according to claim 1 wherein the anti-static amphoteric cleaning composition is an aqueous solution.

4. A packaged product according to claim 1 wherein the anti-static amphoteric cleaning composition comprises a $C_1$ to $C_4$ alkanol.

5. A packaged product according to claim 1 wherein the composition comprises a glossing agent.

6. A packaged product according to claim 5 wherein the glossing agent comprises a poly-$C_1$ to $C_4$ dialkylsiloxanes.

7. A packaged product according to claim 1 wherein the fibrous sheet material is a non-woven fibrous sheet material.

* * * * *